US011858606B2

(12) United States Patent
Rydell

(10) Patent No.: US 11,858,606 B2
(45) Date of Patent: Jan. 2, 2024

(54) WATERCRAFT VEHICLE AND METHOD OF MANOEUVRING THE VEHICLE

(71) Applicant: SAAB AB, Linköping (SE)

(72) Inventor: Anders Rydell, Linköping (SE)

(73) Assignee: SAAB AB, Linköping (SE)

( * ) Notice: Subject to any disclaimer, the term of this patent is extended or adjusted under 35 U.S.C. 154(b) by 0 days.

(21) Appl. No.: 18/044,191

(22) PCT Filed: Sep. 13, 2021

(86) PCT No.: PCT/SE2021/050869
§ 371 (c)(1),
(2) Date: Mar. 6, 2023

(87) PCT Pub. No.: WO2022/060277
PCT Pub. Date: Mar. 24, 2022

(65) Prior Publication Data

US 2023/0257089 A1 Aug. 17, 2023

(30) Foreign Application Priority Data

Sep. 17, 2020 (SE) ..... 2000169-9

(51) Int. Cl.
*B63H 21/21* (2006.01)
*B63H 1/22* (2006.01)
(Continued)

(52) U.S. Cl.
CPC ..... *B63H 1/22* (2013.01); *B63G 8/08* (2013.01); *B63H 21/21* (2013.01); *B63H 23/34* (2013.01);
(Continued)

(58) Field of Classification Search
CPC ..... B63H 1/22; B63H 21/21; B63H 23/34; B63H 2021/216; B63H 25/04;
(Continued)

(56) References Cited

U.S. PATENT DOCUMENTS 3,101,066 A 8/1963 Haselton
5,894,450 A 4/1999 Schmidt et al.
(Continued)

FOREIGN PATENT DOCUMENTS

CN 105366021 A 3/2016
EP 0215629 A2 3/1987
WO WO 2014/160526 A2 10/2014

OTHER PUBLICATIONS

Stenovec et al., An efficient propulsion system for untethered submersible vehicles, 1987, IEEE, p. 371-380 (Year: 1987).*
(Continued)

*Primary Examiner* — Marc McDieunel
(74) *Attorney, Agent, or Firm* — ALSTON & BIRD LLP

(57) ABSTRACT

The present invention regards a watercraft vehicle (1) having a propeller shaft (9) coupled to a motor (3) and a propeller (7) forming a propeller disc (11) having a hub (17). A first blade (8) of the propeller (7) is hingedly coupled to a first oblique lag-pitch hinge (22') of the hub (17) and a second blade (10) of the propeller (7) is hingedly coupled to a second oblique lag-pitch hinge (22") of the hub (17). The first oblique lag-pitch hinge (22') being oriented in a direction oblique to the axis of rotation (RX) and parallel with the second oblique lag-pitch hinge (22"). A control circuitry (5) provides a first thrust (T) in a first arc segment (13') of the propeller disc (11) and provides a second thrust (T") in a second arc segment (13") of the propeller disc (11) by controlling a rate of change of shaft (9) rotational velocity, wherein a first propeller blade pitch change is achieved about the first oblique lag-pitch hinge (22') and a second propeller blade pitch change is achieved about the second oblique lag-pitch hinge (22"). The present invention also regards a method of manoeuvring the watercraft vehicle (1).

15 Claims, 6 Drawing Sheets

(51) Int. Cl.
*B63H 23/34* (2006.01)
*B63G 8/08* (2006.01)
*B63G 8/00* (2006.01)

(52) U.S. Cl.
CPC .. *B63G 2008/004* (2013.01); *B63H 2021/216* (2013.01)

(58) Field of Classification Search
CPC ..... B63H 2025/045; B63G 8/08; B63G 2008/004; B60L 15/20; B60L 2200/32; B63B 9/40; B63B 49/00; B63B 34/10; B63B 79/00; H04W 4/80; H04W 4/021; B63J 99/00; G02B 6/0073; Y02T 10/72
See application file for complete search history.

(56) References Cited

U.S. PATENT DOCUMENTS

| | | | | |
|---|---|---|---|---|
| 6,672,835 | B1 | 1/2004 | Hughes | |
| 9,022,738 | B1 | 5/2015 | Silberg et al. | |
| 9,873,499 | B2 | 1/2018 | Austin et al. | |
| 11,118,936 | B1 * | 9/2021 | Wang | G01C 23/005 |
| 2005/0106955 | A1 | 5/2005 | Atmur | |
| 2016/0125739 | A1 * | 5/2016 | Stewart | G01C 21/203 701/301 |
| 2016/0355247 | A1 | 12/2016 | Ibn Seddik | |
| 2017/0227639 | A1 * | 8/2017 | Stokes | G01S 7/6272 |
| 2018/0346082 | A1 | 12/2018 | Smith et al. | |
| 2019/0009871 | A1 | 1/2019 | Borel et al. | |
| 2020/0050893 | A1 * | 2/2020 | Suresh | G06T 11/40 |
| 2020/0057488 | A1 * | 2/2020 | Johnson | G06T 17/00 |
| 2020/0201359 | A1 * | 6/2020 | Burghardt | G01C 21/005 |
| 2021/0166568 | A1 * | 6/2021 | Kersulec | B63B 43/18 |
| 2021/0206460 | A1 * | 7/2021 | Hawker | B63B 79/10 |
| 2021/0261226 | A1 * | 8/2021 | Johnson | B63B 79/15 |
| 2021/0269128 | A1 * | 9/2021 | Rivers | B63B 79/40 |
| 2021/0291948 | A1 * | 9/2021 | Yamamoto | B63H 20/10 |
| 2022/0043112 | A1 * | 2/2022 | Stokes | G01S 7/417 |

OTHER PUBLICATIONS

Chen et al., Study on the motion characteristics in 3D space for a hybrid-driven underwater gilder based on a folding propulsion mechanism, 2014, IEEE, p. 1-6 (Year: 2014).*

Watson et al., An Engineering Method to Predict Propeller Loads on Maneuvering Underwater Vehicles, 1989, IEEE, p. 777-781 (Year: 1989).*

Healey et al., Toward an improved understanding of thruster dynamics for underwater vehicles, 2002, IEEE, p. 340-352 (Year: 2002).*

International Searching Authority, International Search Report and Written Opinion received for International Application No. PCT/SE2021/050869, dated Oct. 7, 2021, 13 pages, Swedish Patent and Registration Office, Sweden.

Paulos, James, et al., "Emulating a Fully Actuated Aerial Vehicle Using Two Actuators", Proceeding of the 2018 IEEE International Conference on Robotics and Automation (ICRA), May 21-25, 2018, pp. 7011-7016, Brisbane, Australia.

Swedish Patent and Registration Office, Swedish Search Report received for Application No. 2000169-9, dated Apr. 22, 2021, 3 pages, Sweden.

* cited by examiner

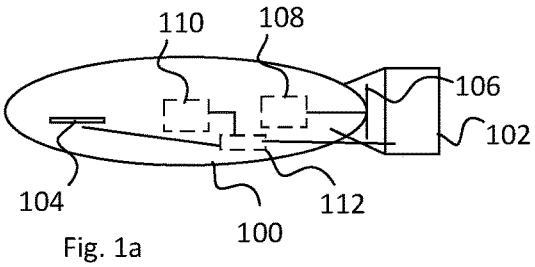
Fig. 1a
Prior art
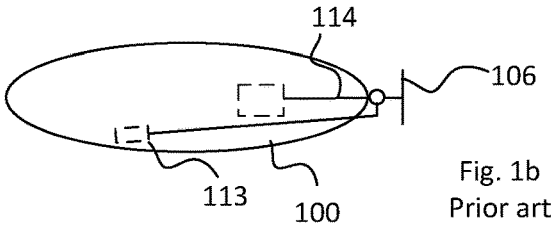
Fig. 1b
Prior art
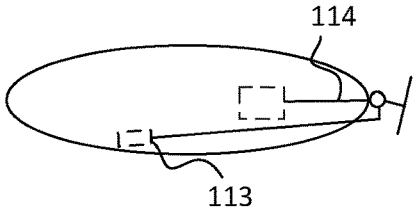
Fig. 1c
Prior art
Fig. 2a
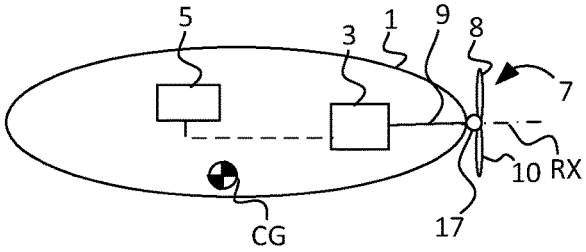
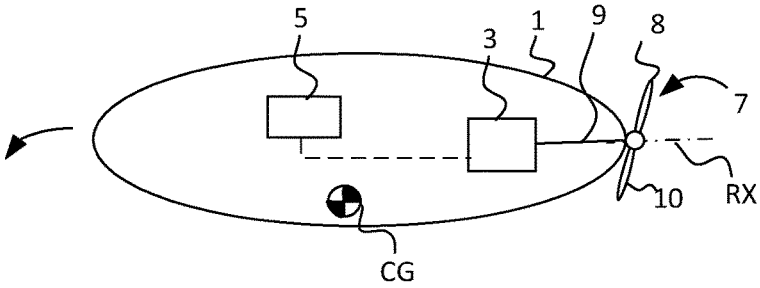
Fig. 2b
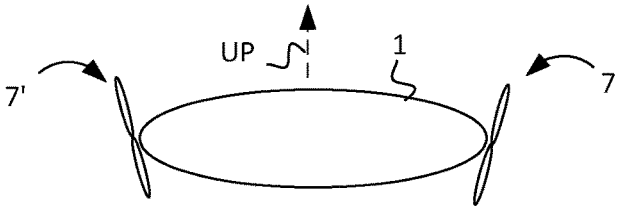
Fig. 2c

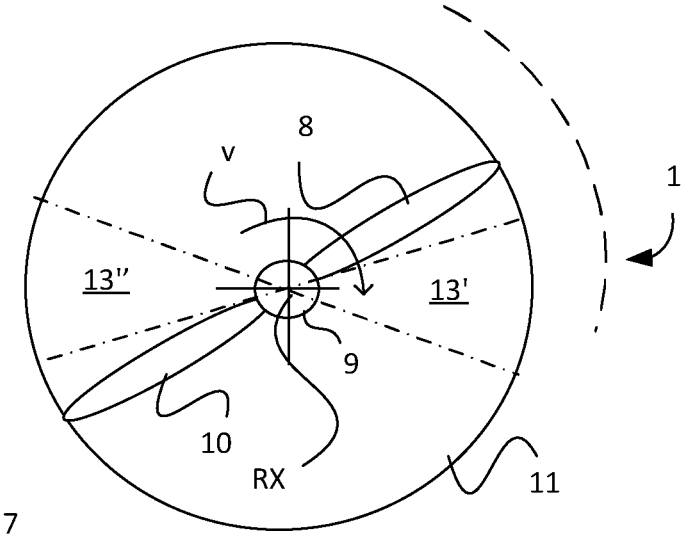
Fig. 7
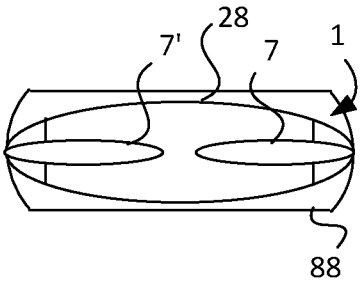
Fig. 8
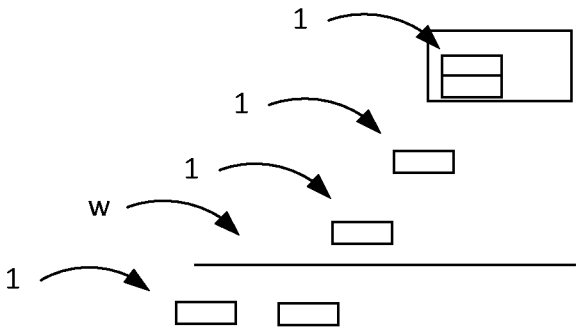
Fig. 10
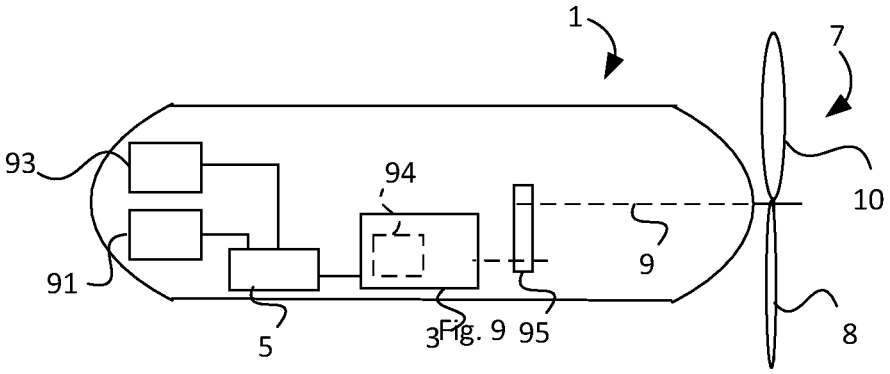
Fig. 9
Fig. 9

WATERCRAFT VEHICLE AND METHOD OF MANOEUVRING THE VEHICLE

CROSS REFERENCE TO RELATED APPLICATIONS

This application is a National Stage Application, filed under 35 U.S.C. 371, of International Application No. PCT/SE2021/050869, filed Sep. 13, 2021, which international application claims priority to and the benefit of Swedish Application No. 2000169-9, filed Sep. 17, 2020; the contents of both of which as are hereby incorporated by reference in their entireties.

BACKGROUND

Related Field

The present invention relates to a watercraft vehicle according to the preamble of claim 1 and to a method of manoeuvring the vehicle according to claim 9.

The present invention primary concerns the watercraft vehicle manufacturing industry and the industry producing manoeuvring systems used in watercraft vehicle.

Description of Related Art

Current watercraft vehicles, such as autonomous underwater vehicles (AUV's) or other underwater vehicles, often make use of control surfaces for manoeuvrability. The control surfaces require servo motors, steering linkages, energy supplies for moving the control surfaces, etc.

A propulsion system of a watercraft vehicle of today constitutes the most complex part of the watercraft vehicle.

One example of an AUV using a control surface is shown in US20180346082A1, which control surface is used to manoeuvre the AUV.

Today, a current asymmetric and static propeller assembly uses asymmetrically positioned propeller blades fixedly positioned around the propeller shaft, wherein manoeuvring is made by increasing the rotational velocity of the propeller shaft in one specific segment causing the propeller blade to travel faster in this segment than in other segments of the propeller disc thus providing a larger thrust force in this specific segment, making the AUV to turn.

BRIEF SUMMARY

There is an object to provide a watercraft vehicle that has a compact manoeuvring and steering system.

There is an object to reduce mechanical complexity in a watercraft vehicle.

There is an object to reduce weight of a watercraft vehicle.

There is an object to provide a watercraft vehicle that is cost-effective to manufacture.

There is an object to provide a compact watercraft vehicle.

There is an object to eliminate, or at least minimize the numbers of control surfaces, such as stern and bow planes, rudder surfaces etc. of a watercraft vehicle.

There is thus an object to provide a watercraft vehicle having a less number of control surface actuating means than the degrees of freedom of manoeuvrability of a watercraft vehicle.

There is an object to increase the reliability of a watercraft vehicle.

There is an object to provide a watercraft vehicle with low sound and vibration signature.

This or at least one of said objects has been achieved by a watercraft vehicle comprising;

- a drive motor arrangement coupled to a control circuitry, configured for manoeuvring the watercraft vehicle;
- a propeller shaft coupled between the drive motor arrangement and a propeller assembly forming a propeller disc during rotation of said propeller shaft about an axis of rotation;
- a hub member of the propeller shaft coupled to the propeller assembly;
- a first propeller blade of the propeller assembly being hingedly coupled to a first oblique lag-pitch hinge of the hub member;
- a second propeller blade of the propeller assembly being hingedly coupled to a second oblique lag-pitch hinge of the hub member;
- a first oblique axis of the first oblique lag-pitch hinge being oriented in a direction oblique to the axis of rotation;
- a second oblique axis of the second oblique lag-pitch hinge being oriented in a direction oblique to the axis of rotation and parallel with the first oblique axis;
- the control circuitry being configured to provide a first drive thrust in a first arc segment of the propeller disc and to provide a second drive thrust in a second arc segment of the propeller disc by controlling a rate of change of the rotational velocity, wherein a first propeller blade pitch change is achieved about the first oblique axis and a second propeller blade pitch change is achieved about the second oblique axis.

Alternatively, the first drive thrust is higher than the second drive thrust for achieving turning and/or change of level of the watercraft vehicle.

Alternatively, the control circuitry being configured to provide a first drive thrust in a first arc segment of the propeller disc by first propeller blade pitch change about the first oblique axis and to provide a second drive thrust in a second arc segment of the propeller disc by second propeller blade pitch change about the second oblique axis, which first and second drive thrust being achieved by acceleration or deceleration of rotational velocity of said rotation, in the first and the second arc segment, for said manoeuvring.

Alternatively, the rate of change of the rotational velocity is acceleration or deceleration.

Alternatively, the first drive thrust is higher than the second drive thrust.

In such way is achieved that the control circuitry is configured to manoeuvre the watercraft vehicle toward the side on which side of the propeller disc the drive thrust is lowest.

For example, if the first arc segment is on the right side of the watercraft vehicle and the second arc segment is on the left side of the watercraft vehicle, and the first drive thrust is higher than the second drive thrust, the watercraft vehicle turns to the left.

For example, if the first arc segment is on the left side of the watercraft vehicle and the second arc segment is on the right side of the watercraft vehicle, and the first drive thrust is higher than the second drive thrust, the watercraft vehicle turns to the right.

For example, if the first arc segment is on the upper side of the watercraft vehicle and the second arc segment is on the lower side of the watercraft vehicle, and the first drive thrust is higher than the second drive thrust, the watercraft vehicle is angled downward.

For example, if the first arc segment is on the upper side of the watercraft vehicle and the second arc segment is on the lower side of the watercraft vehicle, and the first drive thrust is lower than the second drive thrust, the watercraft vehicle is angled upward.

Alternatively, the first arc segment is opposite the second arc segment.

In such way is achieved that the propeller disc, due to distinguishing first and second drive thrusts of opposite first and second arc segments of the propeller disc, will provide more thrust from a first side of the propeller disc in relation to a second side of the propeller disc, wherein the first side of the propeller disc is opposite the second side of the propeller disc and being on each side of the hub member.

Alternatively, the control circuitry is configured to manoeuvre the watercraft vehicle by acceleration or deceleration of rotational velocity of said rotation.

Alternatively, the control circuitry is configured to control the acceleration or deceleration of rotational velocity of said rotation of the propeller shaft.

Alternatively, the control circuitry is configured to be waterproof sealed.

Alternatively, the control circuitry is mounted inside a hull of the watercraft vehicle, which hull encloses a drive motor of the drive motor arrangement.

In such way bulky control surface arrangement of the propulsion system of the watercraft vehicle is not needed and thus replaced by a water sealed electronic control circuitry.

Alternatively, the hub member is hingedly coupled to the propeller shaft via a teetering hinge having a teetering hinge axis, which is oriented, suitably in a neutral state, normal to the axis of rotation of the propeller shaft.

Alternatively, the control circuitry is configured to pivot the propeller disc about the teetering hinge axis by controlling said rate of change of the rotational velocity.

Alternatively, the teetering hinge comprises a universal joint unit.

Alternatively, by pivoting the propeller disc about the teetering hinge axis, the control circuitry manoeuvres the watercraft vehicle.

In such way is achieved that the control circuitry is configured to manoeuvre the watercraft vehicle toward the side on which side of the propeller disc the drive thrust is highest.

For example, if the first arc segment is on the right side of the watercraft vehicle and the second arc segment is on the left side of the watercraft vehicle, and the first drive thrust is higher than the second drive thrust, the watercraft vehicle turns to the right.

For example, this is achieved by the fact that the higher drive thrust, generated by the first arc segment, will pivot the propeller disc about the teetering hinge counter-clockwise (the watercraft seen from above) involving that the direction of the total force of the main thrust of the propeller disc is oriented in a direction different from the extension of the central axis of the watercraft vehicle, i.e. turning the watercraft vehicle to the right.

This is achieved by the fact that the higher drive thrust, generated by the first arc segment, will pivot the propeller disc about the teetering hinge involving that the direction of the total force of the main thrust of the propeller disc is oriented in a direction different from the extension of the central axis of the watercraft vehicle.

For example, if the propeller disc pivots to the right, the watercraft vehicle turns to the right.

For example, if the propeller disc pivots to the left, the watercraft vehicle turns to the left.

For example, if the propeller disc pivots upward, the watercraft vehicle is angled upward.

For example, if the propeller disc pivots downward, the watercraft vehicle is angled downward.

Alternatively, a first propeller blade pitch change involves increased angle of attack of the first propeller blade generating larger thrust of the first propeller blade in the first arc segment and a second propeller blade pitch change involves decreased angle of attack of the second propeller blade generating smaller thrust of the second propeller blade in the second arc segment.

Alternatively, the first oblique axis is oriented asymmetric to the second oblique axis on both sides of the hub member, i.e. in opposite sides of the hub member.

Alternatively, the first oblique axis is opposite the second oblique axis, wherein the first and second oblique axis being positioned on both sides of the teetering hinge seen in a direction transverse to the teetering hinge axis.

Alternatively, the control circuitry is configured to momentary increase, when the first propeller blade is positioned in the first arc segment and the second propeller blade is positioned in the second arc segment, the rotational velocity of the propeller shaft so that the first propeller blade pitch change involves increased angle of attack and the second propeller blade pitch change involves decreased angle of attack.

Alternatively, a first angle of 45° is defined between the first oblique axis and the axis of rotation; and a second angle of 45° is defined between the second oblique axis and the axis of rotation.

This or at least one of said objects has been achieved by a method of manoeuvring a watercraft vehicle comprising;

- a drive motor arrangement coupled to a control circuitry configured for manoeuvring the watercraft vehicle;
- a propeller shaft coupled between the drive motor arrangement and a propeller assembly, forming a propeller disc during rotation of said propeller shaft about an axis of rotation;
- a hub member of the propeller shaft coupled to the propeller assembly;
- a first propeller blade of the propeller assembly being hingedly coupled to a first oblique lag-pitch hinge of the hub member;
- a second propeller blade of the propeller assembly being hingedly coupled to a second oblique lag-pitch hinge of the hub member;
- a first oblique axis of the first oblique lag-pitch hinge being oriented in a direction oblique to the axis of rotation;
- a second oblique axis of the second oblique lag-pitch hinge being oriented in a direction oblique to the axis of rotation and parallel with the first oblique axis;
- the control circuitry being configured to provide a first drive thrust in a first arc segment of the propeller disc and to provide a second drive thrust in a second arc segment of the propeller disc by controlling a rate of change of rotational velocity; wherein the method comprises the steps of:
- rotating the propeller shaft about the axis of rotation forming the propeller disc;
- changing the rotational velocity for achieving said rate of change of rotational velocity in said first arc segment for providing a first propeller blade pitch change about the first oblique axis and for achieving said rate of change of rotational velocity in said second arc segment for providing a second propeller blade pitch change about the second oblique axis;

increasing the angle of attack of the first propeller blade by said first propeller blade pitch change generating larger thrust of the first propeller blade in the first arc segment;

decreasing the angle of attack of the second propeller blade by said second propeller blade pitch change generating smaller thrust of the second propeller blade in the second arc segment, and providing constant rate of rotation of the propeller shaft for generating linear thrust.

Alternatively, the method comprises the further step of pivoting the propeller disc about a teetering hinge axis by the provided first and second propeller blade pitch change.

This or at least one of said objects has been achieved by a set of co-operative watercraft vehicles of the type according to claim 1, each watercraft vehicle comprises a communication circuitry coupled to the control circuitry, the communication circuitry is configured to communicate with the co-operative watercraft vehicles.

Alternatively, the watercraft vehicle further comprises a sensor device coupled to the control circuitry.

Alternatively, the sensor device comprises a camera configured for generating remote sensing images.

Alternatively, the sensor device comprises a thermal detector

Alternatively, the sensor device comprises an ultra-sonic detector.

Alternatively, the sensor device comprises an under-water object sensing detector.

Alternatively, the sensor device comprises a global positioning system GPS receiver.

In such way is provided a low-cost, intelligent and compact set of co-operative watercraft vehicles, such as AUV's, configured for remote operation.

In such way is provided possible launch of a swarm of autonomous maritime and underwater vehicles being less complex the prior art.

In such way is provided a low-cost, intelligent and compact set of co-operative watercraft vehicles configured for military operation.

In such way is provided a low-cost, intelligent and compact set of co-operative watercraft vehicles configured for search-and-rescue mission.

Alternatively, the watercraft vehicle comprises software/hardware components, adopted and incorporated into the control circuitry for providing autonomy, robustness, cost-effectiveness, reliability, etc.

In such way is provided a watercraft vehicle and/or a set of co-operative watercraft vehicles configured for offshore operations, such as corrosion prevention in offshore installations, monitoring of chemical pollution, other inspections, seabed mapping etc.

In such way is provided watercraft vehicle and a set of co-operative watercraft vehicles.

In such way it is achieved a compact launch compartment configured to store and launch a set of co-operative watercraft vehicles, such as a drone swarm or micro-drones, able to make decisions among themselves in operation.

This or at least one of said objects has been achieved by a data medium storing a data program (P) configured for manoeuvring a watercraft vehicle according to claim 1 or 11, wherein said data program (P) comprises a program code stored on the data medium, which is readable on a computer, for causing the control circuitry to perform the method steps of: rotating the propeller shaft about the axis of rotation forming the propeller disc; changing the rotational velocity for achieving said rate of change of rotational velocity in said first arc segment for providing a first propeller blade pitch change about the first oblique axis and for achieving said rate of change of rotational velocity in said second arc segment for providing a second propeller blade pitch change about the second oblique axis; increasing the angle of attack of the first propeller blade by said first propeller blade pitch change generating larger thrust of the first propeller blade in the first arc segment; decreasing the angle of attack of the second propeller blade by said second propeller blade pitch change generating smaller thrust of the second propeller blade in the second arc segment, and providing constant rate of rotation of the propeller shaft for generating linear thrust.

This or at least one of said objects has been achieved by a data program product comprising a program code stored on the data medium, which program code is readable on a computer for performing the method steps according to claim 9, when the data program is run on the control circuitry.

This is achieved by the fact that the higher drive thrust, generated by the first arc segment, will pivot the propeller disc about the teetering hinge involving that the direction of the total force of the main thrust of the propeller disc is oriented in a direction different from the extension of the central axis of the watercraft vehicle.

Alternatively, the hub member is hingedly coupled to the propeller shaft via a teetering hinge having a teetering hinge axis, which is oriented, in a neutral state, normal to the axis of rotation of the propeller shaft.

Alternatively, the changing of said rotational velocity involves accelerating or decelerating the rotational velocity of the propeller shaft.

Alternatively, the changing of said rotational velocity in said first and second arc segment for providing a first propeller blade pitch change about the first oblique axis and a second propeller blade pitch change about the second oblique axis; wherein the first propeller blade pitch change involves increased angle of attack of the first propeller blade generating larger thrust of the first propeller blade in the first arc segment, and the second propeller blade pitch change involves decreased angle of attack of the first propeller blade generating smaller thrust of the second propeller blade in the second arc segment.

Alternatively, the control circuitry is configured to, twice per revolution of the propeller shaft, momentary change the drive thrust of the motor for providing acceleration of the first propeller blade and the second propeller blade, wherein the first propeller blade pivots to a lower angle of attack and the second propeller blade pivots to a higher angle of attack, thereby turning the watercraft vehicle.

Alternatively, the first propeller blade exhibits a first angle of attack when subjected to constant rate of rotation of the propeller axis, which first angle of attack generates a first thrust.

Alternatively, the first propeller blade pitch change involves increased angle of attack of the first propeller blade generating larger thrust of the first propeller blade in the first arc segment than the first thrust.

Alternatively, the second propeller blade exhibits a second angle of attack when subjected to constant rate of rotation of the propeller axis, which second angle of attack generates a second thrust.

Alternatively, the second propeller blade pitch change involves decreased angle of attack of the second propeller blade generating smaller thrust of the second propeller blade in the second arc segment than the second thrust.

Alternatively, the first thrust is of the same amount as that of the second thrust.

Alternatively, when the control circuitry changes the drive thrust and/or the rate of change of the rotational velocity of said rotation once or twice per revolution of the propeller shaft at the same time as the first propeller blade enters the first arc segment, also the second propeller blade enters the second arc segment, and as the first arc segment is opposite the second arc segment and the first propeller blade is opposite the second propeller blade, the changed drive thrust urges the first and second propeller blade into a first respective second lagging position, the first propeller blade will pivot about the first oblique axis providing an increased angle of attack and the second propeller blade will pivot about the second oblique axis providing an decreased angle of attack.

Alternatively, the opposite first and second oblique axis being asymmetrically coupled to the hub.

Alternatively, the control circuitry is configured to control the drive motor arrangement to provide said constant rate of rotation of the propeller axis, which constant rate of rotation of the propeller axis provides a linear thrust, corresponding with the first thrust added to the second thrust, generated by the propeller disc, wherein the watercraft vehicle moves along a straight course.

Alternatively, the first oblique axis is oriented asymmetric to the second oblique axis and being positioned opposite to the second oblique axis relative the axis of rotation, wherein the first and second oblique axis being positioned on both sides of the teetering hinge.

Alternatively, the first and second oblique lag-pitch hinge is positioned along an imaginary line extending transverse to the teetering hinge axis.

Alternatively, the first arc segment extends in a direction extending transverse to the teetering hinge axis.

Alternatively, the second arc segment extends in a direction transverse to the teetering hinge axis and extending in a direction opposite that of the first arc segment and the axis of rotation is located there between.

Alternatively, the hub member is configured to freely pivot about the teetering hinge.

Alternatively, the first propeller blade is configured to freely pivot about the first oblique axis.

Alternatively, a plane of rotation of the propeller assembly defines the propeller disc.

Alternatively, the control circuitry being configured to increase, when the first propeller blade is positioned in the first arc segment and/or the second propeller blade is positioned in the second arc segment, momentary the rotation rate of the propeller shaft (changing the drive thrust) so that a first propeller blade pitch change involves increased angle of attack and/or the second propeller 25 blade pitch change involves decreased angle of attack.

Alternatively, the first oblique axis defines such inclination relative the axis of rotation of the propeller shaft that the first propeller blade will be urged into a first lagging position, when momentary increasing the rotation rate of the propeller shaft.

Alternatively, to reach the first lagging position, the first propeller blade freely pivots about the first oblique axis thereby twisting the first propeller blade and increasing the angle of attack of the first propeller blade.

Alternatively, the second oblique axis defines such inclination relative the axis of rotation of the propeller shaft that the second propeller blade will be urged into a second lagging position, when momentary increasing the rotation rate of the propeller shaft.

Alternatively, to reach the second lagging position, the second propeller blade freely pivots about the second oblique axis thereby twisting the second propeller blade and decreasing the angle of attack of the second propeller blade.

Alternatively, the control circuitry is configured to provide momentary changing of the rotation rate of the propeller shaft (changing the drive thrust) every revolution when the first propeller blade is positioned in the first arc segment and/or the second propeller blade is positioned in the second arc segment.

Alternatively, the control circuitry being configured to decrease, when the first propeller blade is positioned in the first arc segment and/or the second propeller blade is positioned in the second arc segment, momentary the rotation rate of the propeller shaft (changing the drive thrust) so that a first propeller blade pitch change involves decreased angle of attack and/or the second propeller blade pitch change involves increased angle of attack.

Alternatively, a sensor arrangement of the control circuitry is configured to detect the angular position of the first and second propeller blades, wherein the control circuitry is configured to, from received control signals, define new positions of the first and second arc segment upon desired watercraft vehicle manoeuvres to be made.

Alternatively, for compact storage of the set of co-operative watercraft vehicles in the launch compartment, the respective first and second propeller blade being folded into contact with and along the hull of the watercraft vehicle.

Alternatively, the first propeller blade is configured to be folded about the first oblique lag-pitch hinge.

Alternatively, the second propeller blade is configured to be folded about the second oblique lag-pitch hinge.

BRIEF DESCRIPTION OF THE FIGURES

The present invention will now be described by way of examples with references to the accompanying schematic drawings, of which:

FIGS. 1*a*-1*c* illustrate known watercraft vehicles according to prior art;

FIGS. 2*a*-2*c* illustrate watercraft vehicles according to a first, second and third example in a view from side;

FIG. 7 illustrates a propeller disc of a watercraft vehicle according to a tenth example;

FIG. 8 illustrates a further example of a watercraft vehicle;

FIG. 9 illustrates a watercraft vehicle according to a further example;

FIG. 10 illustrates a set of co-operative watercraft vehicles according to a further example;

DETAILED DESCRIPTION OF VARIOUS EMBODIMENTS

Figure 3A:
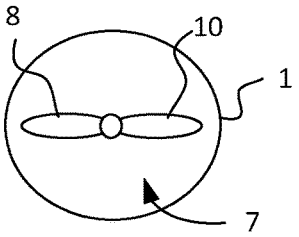
FIGS. 3*a*-3*c* illustrate watercraft vehicles according to a fourth, fifth and sixth example in a view from behind.

Hereinafter, exemplary embodiments of the present invention will be described with reference to the accompanying drawings, wherein for the sake of clarity and understanding of the invention some details of no importance may be deleted from the drawings.

FIGS. 1*a*-1*c* illustrate known watercraft vehicles according to prior art. FIG. 1*a* shows a current watercraft vehicle 100 comprises a rudder 102, a bow plane 104, a propeller 106 coupled to a motor 108. A control circuitry 110 is coupled to the rudder 102 and the bow plane 104 for manoeuvring the watercraft vehicle 100. A servo arrangement 112 being controlled by the control circuitry 110 and is coupled to the rudder 102 and bow plane 104. FIG. 1*b* shows a current watercraft vehicle 100 comprising a propeller arrangement 106 hingedly coupled to a propeller shaft 114. The propeller arrangement 106 is configured to pivot and is operated by a servo motor 113 for manoeuvring the watercraft vehicle 100 as shown in FIG. 1*c*.

FIG. 2*a* illustrates an autonomous underwater vehicle 1 according to a first example in a view from side. Center of gravity CG is located low in the autonomous underwater vehicle 1 for providing stability of the autonomous underwater vehicle 1. The autonomous underwater vehicle 1 comprises a drive motor arrangement 3 coupled to a control circuitry 5. The drive motor 3 is coupled to a propeller 7 via propeller shaft 9. The propeller 7 has a first propeller blade 8 and an opposite second propeller blade 10, which propeller 7 defines a propeller disc 11 (see e.g. FIG. 7) having a first 13' and a second 13" arc segment (see e.g. FIG. 7) under rotation of the propeller shaft 9 about an axis of rotation RX. The propeller assembly is coupled to a hub 17 of the propeller shaft 9. The control circuitry 5 is configured for manoeuvring the autonomous underwater vehicle 1 by providing a first drive thrust in the first arc segment 13' and to provide a second drive thrust in the second arc segment 13" by that the control circuitry 5 is configured to control rate of change of the rotational velocity of the drive motor 3 and the propeller shaft 9, e.g. accelerating the rotational velocity, wherein a first propeller blade pitch change is achieved about a first oblique axis (reference 21', see e.g. FIG. 6*g*) about which the first propeller blade 8 pivots and second propeller blade pitch change is achieved about a second oblique axis (reference 21", see e.g. FIG. 6*g*) about which the second propeller blade 10 pivots. As shown in FIG. 6*g*, the first oblique axis 21' is oriented asymmetric to the second oblique axis 21", which is arranged opposite the first oblique axis 21' on the other side of the propeller shaft 9. The hub 17, carrying a first oblique lag-pitch hinge 22' and a second oblique lag-pitch hinge 22" (See FIG. 6*g*), is provided between the propeller shaft 9 and the propeller blades. The first propeller blade 8 of the propeller 7 is thus hingedly coupled to the first oblique lag-pitch hinge 22' and the second propeller blade 10 is hingedly coupled to the second oblique lag-pitch hinge 22".

In FIG. 6*g* is shown the first oblique axis 21' of the first oblique lag-pitch hinge 22' is oriented in a direction oblique to the axis of rotation RX. The second oblique axis 21" of the second oblique lag-pitch hinge 22" is oriented in a direction oblique to the axis of rotation RX and parallel with the first oblique axis 21'.

Alternatively, the hub 17 of the propeller 7 is hingedly coupled to the propeller shaft 9 via a teetering hinge 25 having a teetering hinge axis 26, which is oriented, in a neutral state of the propeller disc, normal to the axis of rotation RX of the propeller shaft 9.

Alternatively, the control circuitry 5 is configured to pivot the propeller disc 11 about the teetering hinge axis 26 by controlling said rate of change of the rotational velocity.

This is achieved by the fact that the higher drive thrust, generated by the first arc segment 13' (see FIG. 7), will pivot the propeller disc about the teetering hinge axis 26 involving that the direction of the total force of the main thrust of the propeller disc 11 is oriented in a direction different from the extension of the central axis CA of the watercraft vehicle 1.

Alternatively, the teetering hinge may comprise a universal joint unit.

In FIG. 2*b* is shown an autonomous underwater vehicle 1 according to a second example. It is show that the watercraft vehicle 1 is angled downward when the circuitry 5 manoeuvres the autonomous underwater vehicle to dive by pivoting the propeller disc 11 (see FIG. 7) downward. Consequently, by pivoting the propeller disc about the teetering hinge axis 26, the control circuitry manoeuvres the autonomous underwater vehicle 1.

In this case, the first arc segment is on the lower side of the propeller disc 11 and the second arc segment is on the upper side of the propeller disc, and the first drive thrust is higher than the second drive thrust, the autonomous underwater vehicle 1 thus turns downward.

In FIG. 2*c* is shown a watercraft vehicle 1 according to a third example making use of a second propeller 7'. A propeller disc of the second propeller 7' and a propeller disc of the first propeller 7 are pivoted downward for moving the watercraft vehicle 1 upward UP.

Figure 3B:
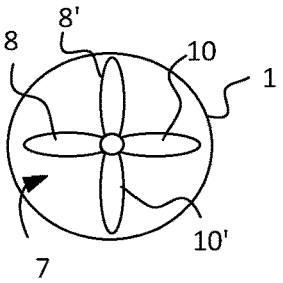
Figure 3C:
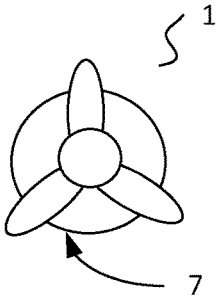

FIGS. 3*a*-3*c* illustrate watercraft vehicles 1 according to a fourth, fifth and sixth example in a view from behind. FIG. 3*a* shows a propeller 7 with two propeller blades 8, 10. FIG. 3*b* shows a propeller 7 with four propeller blades 8, 8', 10, 10'. FIG. 3*c* shows a propeller 7 with three propeller blades.

Figure 4:
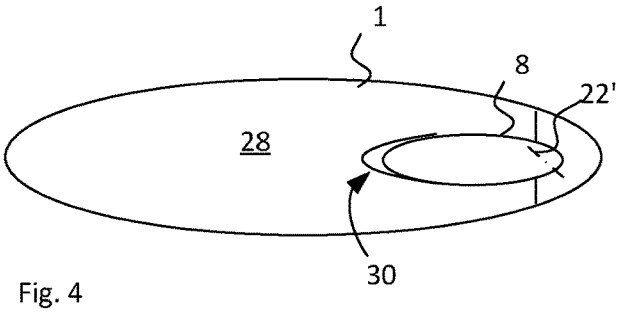
FIG. 4 illustrates a section of a watercraft vehicle according to a seventh example.

FIG. 4 illustrates a section of a watercraft vehicle 1 having a hull 28 according to a seventh example. Alternatively, for compact storage of the watercraft vehicle 1 in e.g. a launch compartment (not shown), a respective first 8 and second (not shown) propeller blade can be folded into contact with and along the hull 28 of the watercraft vehicle 1. In this example, the first and second propeller blade are encompassed into recesses 30 (only one is shown) of the hull 28. The first propeller blade 8 is folded about its first oblique lag-pitch hinge 22' and the second propeller blades are folded about the second oblique lag-pitch hinge (not shown).

Figure 5:
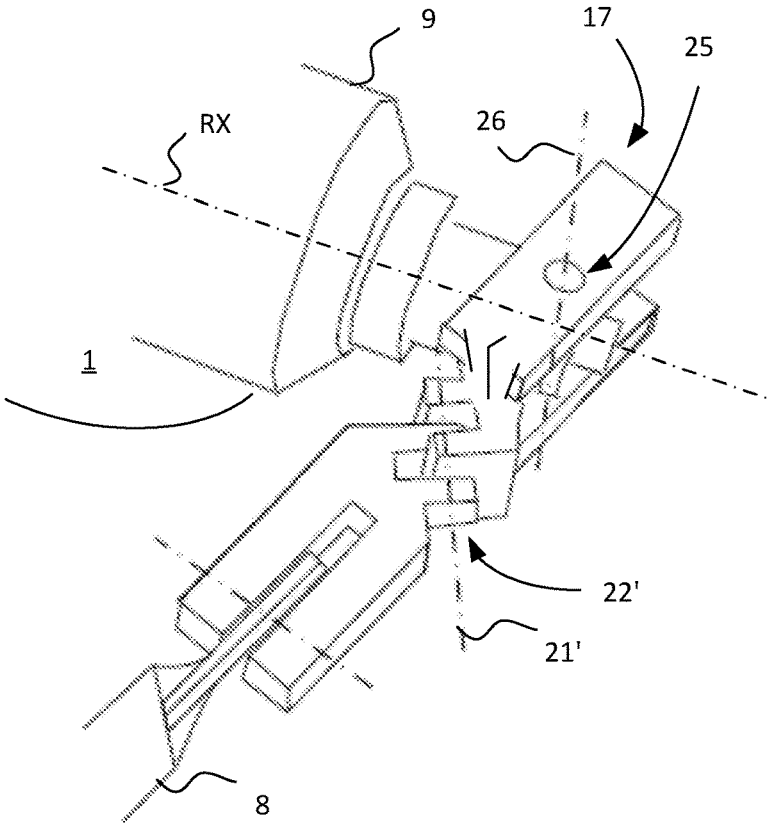
FIG. 5 illustrates a hub member of a propeller shaft of a watercraft vehicle according to an eight example in a perspective view.

FIG. 5 illustrates a hub 17 of a propeller shaft 9 of a watercraft vehicle 1 according to an eight example in a perspective view. A first propeller blade 8 is coupled to the hub 17 of the propeller shaft 9 via a first oblique lag-pitch hinge 22' of the hub 17. A second propeller blade (not shown) opposite the first propeller blade 8 is coupled to the hub 17 via a second oblique lag-pitch hinge (not shown) of the hub 17. The hub 17, carrying the first oblique lag-pitch hinge 22' and the second oblique lag-pitch hinge, is thus coupled between the propeller shaft 9 and the propeller blades. The first propeller blade 8 is thus hingedly arranged about a first oblique axis 21' of the first oblique lag-pitch hinge 22'. The second propeller blade is thus hingedly arranged about a second oblique axis (not shown) of the second oblique lag-pitch hinge. The first oblique axis 21' of the first oblique lag-pitch hinge 22' is oriented in a direction oblique to the axis of rotation RX when the hub 17 is in neutral state (not pivoted relative the axis of rotation RX). The second oblique axis (not shown) of the second oblique lag-pitch hinge (not shown) is oriented in a direction oblique to the axis of rotation RX and parallel with the first oblique axis 21'.

Alternatively, the hub 17 is hingedly coupled to the propeller shaft 9 via a teetering hinge 25 having a teetering hinge axis 26. The teetering hinge axis 26 is oriented normal (transverse) to the axis of rotation RX of the propeller shaft 9.

Alternatively, a control circuitry (not shown) of the watercraft vehicle 1 is configured to pivot the hub 17 and thus the propeller disc about the teetering hinge axis 26 by controlling rate of change of the rotational velocity of the propeller shaft 9 in a first arc segment of the propeller disc (e.g. see FIG. 7). The control circuitry is thus configured for manoeuvring the autonomous underwater vehicle 1 by providing a first drive thrust in the first arc segment and to provide a second drive thrust in a second arc segment for pivoting the propeller disc for manoeuvring the watercraft vehicle 1.

Figure 6A:
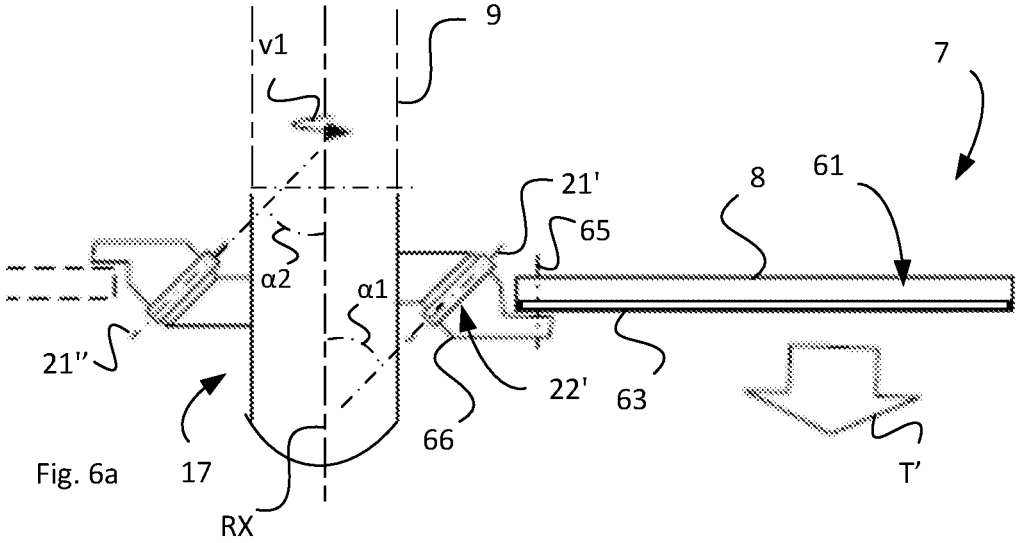
FIGS. 6*a*-6*g* illustrate the functionality of a propeller assembly of a watercraft vehicle according to a ninth example.
Figure 6B:
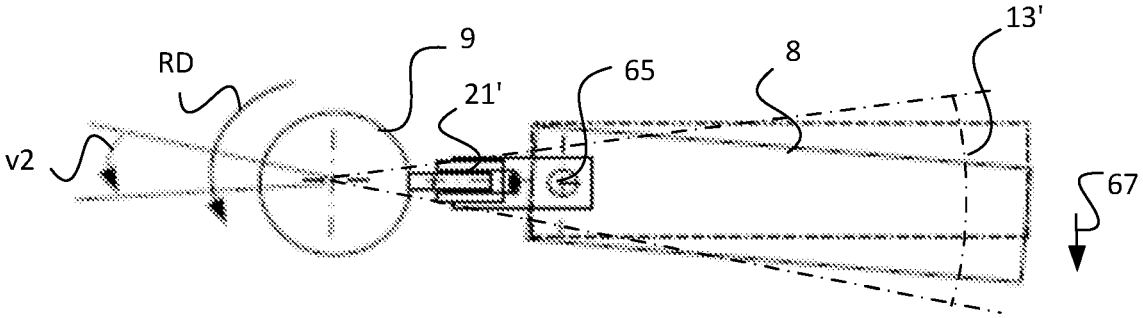
Figure 6C:
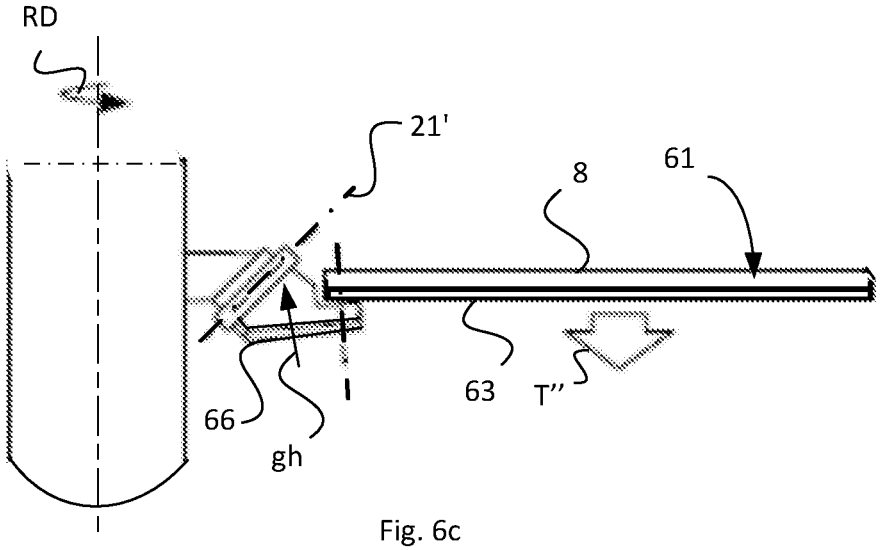
Figure 6D:
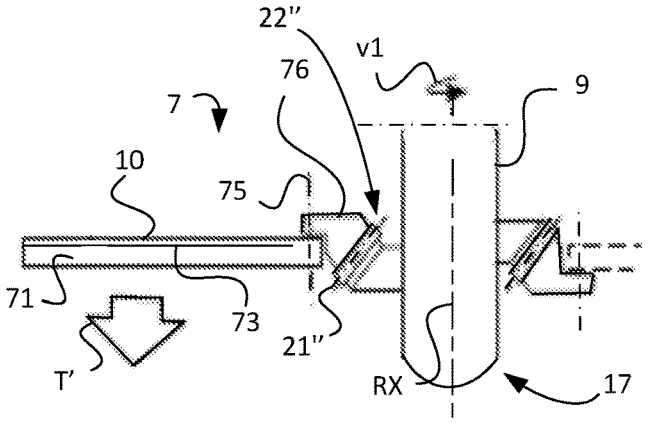
Figure 6E:
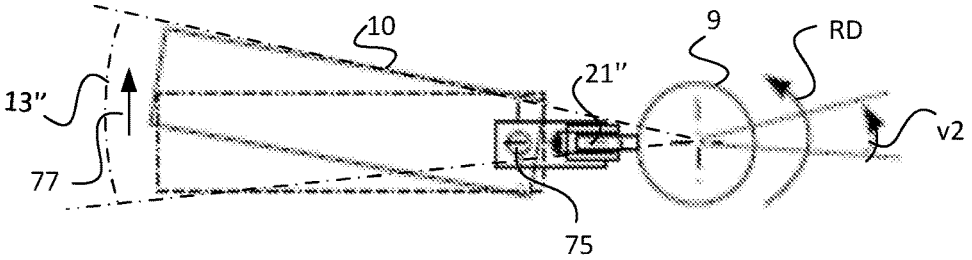
Figure 6F:
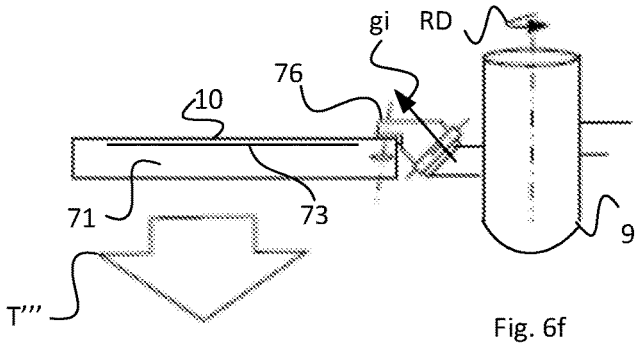
Figure 6G:
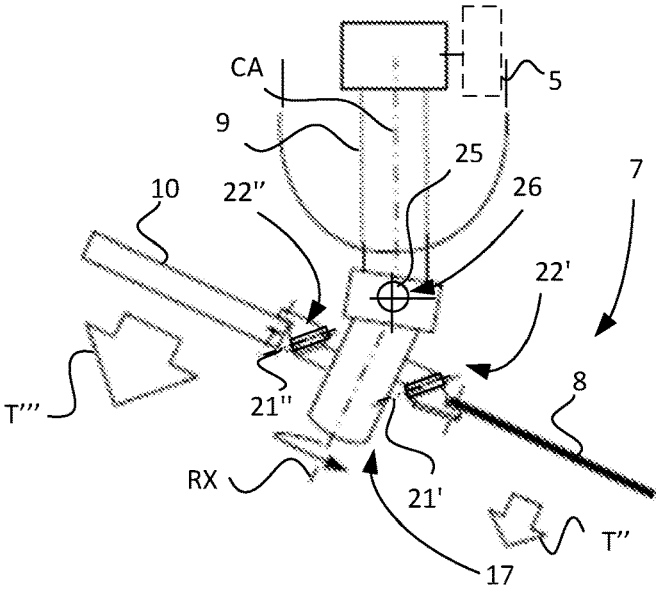

FIGS. 6*a*-6*g* illustrate an exemplary functionality of a propeller assembly 7 of a stern of a watercraft vehicle according to a ninth example. A propeller shaft 9 is rotated about the axis of rotation RX and in clockwise rotation direction RD (by means of a motor of the watercraft vehicle, not shown) seen in a view from behind of the watercraft vehicle. In FIG. 6*a* is shown a first propeller blade 8 comprising an upper side 61 and a lower side (hidden) and a trailing edge 63.

An inner end of the first propeller blade 8 may be hingedly arranged about a first lead lag hinge 65 of a first yoke 66. The first lead lag hinge 65 extends parallel with the axis of rotation in a neutral state (wherein the propeller blade neither being accelerated nor decelerated but being at constant rotational velocity).

The first yoke 66 may be hingedly coupled to a first oblique axis 21' of a first oblique lag-pitch hinge 22' of a hub 17. A second oblique axis 21" is provided on the other side of the axis of rotation RX.

Alternatively, a first angle $\alpha 1$ of 45° is defined between the first oblique axis and the axis of rotation and a second angle $\alpha 2$ of 45° is defined between the second oblique axis 21" and the axis of rotation RX. The first oblique axis 21' is oriented parallel with the second oblique axis 21".

The first propeller blade 8 exhibits a first pitch angle and/or first angle of attack due under constant rotational velocity (constituting the initial velocity v1 discussed below) of the propeller shaft 9, which generates a first drive thrust T' (in said neutral state).

A control circuitry (not shown) is configured to momentary increase, when the first propeller blade 8 is positioned in a first arc segment 13' (FIG. 6*b*), the rotational velocity of the propeller shaft 9. This is achieved by momentary increasing the rotational velocity of the motor.

Alternatively, by the controlled momentary acceleration of the rotational velocity of the propeller shaft 9, the first propeller blade 8 will pivot about the lead lag hinge 65 slightly in a direction opposite the rotation direction RD of the propeller shaft 9 according to arrow 67.

Under the momentary acceleration of the rotational velocity in the first arc segment 13' toward a higher velocity v2, the first propeller blade 8, due to its inertia, strives in a direction opposite the rotation direction RD of the propeller shaft 9. This implies that the first propeller blade 8 will pivot about the first oblique axis 21' of the first oblique lag-pitch hinge 22' and decreasing its first pitch angle and/or first angle of attack. The first propeller blade 8 will thus pivot about the first oblique axis 21' and change (decrease) its first pitch angle and/or first angle of attack momentary to a second pitch angle and/or second angle of attack in the first arc segment 13', which generates a second drive thrust T", as shown in FIG. 6*c*.

In FIG. 6*c* is shown that the first yoke 66 together with the first propeller blade 8, due to said inertia of the first propeller blade 8 and said acceleration, is rotated about the first oblique axis 21' (arrow gh) and thus decreasing the first pitch angle and/or first angle of attack of the first propeller blade 8 exposing a less lower side 71 to the water mass to be displaced.

Due to the lower second pitch angle and/or second angle of attack, the second drive thrust T" is lower than the first drive thrust T'.

Subsequently, the rotational velocity v2 is decelerated to the initial velocity v1 and the first propeller blade 8 pivots back to the first pitch angle and/or first angle of attack, again generating the first drive thrust T'.

The control circuitry thus being configured to provide a first drive thrust T' in the first arc segment of the propeller disc and being configured to provide a second drive thrust T2 in a second arc segment of the propeller disc by controlling said rate of change of the rotational velocity (here acceleration), wherein the first propeller blade pitch change is achieved about the first oblique axis and a second propeller blade pitch change is achieved about the second oblique axis, further explained in regard to a second propeller blade 10 (FIGS. 6*d*-6*g*).

The sequence described in regard to FIGS. 6*d*-6*g* occurs simultaneously with the sequence described in regard to FIGS. 6*a*-6*c*.

The propeller shaft 9 rotates about the axis of rotation RX and in clockwise rotation direction RD. In FIG. 6*d* is shown the second propeller blade 10 comprising a lower side 71 and an upper side (hidden) and a leading edge 73.

An inner end of the second propeller blade 10 may be hingedly arranged about a second lead lag hinge 75 of a second yoke 76. The second lead lag hinge 75 extends parallel with the axis of rotation in said neutral state.

The second yoke 76 may be hingedly coupled to a second oblique axis 21" of a second oblique lag-pitch hinge 22" of the hub 17. The second propeller blade 10 exhibits a second pitch angle and/or second angle of attack under said constant rotational velocity generating a drive thrust (in said neutral state) corresponding with the first drive thrust T' of the first propeller blade 8.

The second pitch angle and/or second angle of attack may preferably exhibit the same pitch angle and/or angle of attack as that of the first pitch angle and/or first angle of attack of the first propeller blade 8 under said constant rotational velocity.

The control circuitry momentary increases, when the second propeller blade 10 is positioned in a second arc segment 13" (FIG. 6*e*), the rotational velocity of the propeller shaft 9. The second propeller blade 10 is positioned in a second arc segment 13" at the same time as the first propeller blade 8 is positioned in the first arc segment 13' shown in FIG. 6*b*.

Alternatively, by the controlled momentary acceleration of the rotational velocity of the propeller shaft 9, the second propeller blade 10 will pivot about the second lead lag hinge 75 slightly in a direction opposite the rotation direction RD of the propeller shaft 9 according to arrow 77.

Under the momentary acceleration of the rotational velocity of the propeller shaft 9 in the second arc segment 13" toward the higher velocity v2, the second propeller blade 10, due to its inertia, strives in a direction opposite the rotation direction RD of the propeller shaft 9. This implies that the second propeller blade 10 will pivot about the second oblique axis 21" of the second oblique lag-pitch hinge 22' and increasing its (first) pitch angle and/or (first) angle of attack. The second propeller blade 10 will thus pivot about the second oblique axis 21" and change (increase) its (first) pitch angle and/or (first) angle of attack momentary to a third pitch angle and/or third angle of attack in the second arc segment 13", which generates a third drive thrust T", as shown in FIG. 6*f*. Due to the increased third pitch angle and/or third angle of attack, the third drive thrust T'" is higher than the first drive thrust T'.

In FIG. 6*f* is shown that the second yoke 76 together with the second propeller blade 10, due to said inertia of the second propeller blade 10 and said acceleration, is rotated about the second oblique axis 21" (arrow gi) and thus increasing the first pitch angle and/or first angle of attack of the second propeller blade 10 exposing a larger lower side 71 to the water mass to be displaced.

Subsequently, the rotational velocity v2 is decelerated to the initial velocity v1 and the second propeller blade 10 pivots back to the first pitch angle and/or first angle of attack, again generating the first drive thrust T' as shown in FIG. 6*d*.

In FIG. 6*g* is shown that the hub 17 of the propeller assembly 7 is hingedly coupled to the propeller shaft 9 via a teetering hinge 25 having a teetering hinge axis 26, which is oriented, in a neutral state (the second drive thrust T" being equal to the third drive thrust T'" of the propeller disc), normal to the axis of rotation RX of the propeller shaft 9.

Alternatively, a control circuitry 5 is configured to pivot the propeller disc 11 about the teetering hinge axis 26 by controlling said rate of change of the rotational velocity by applying a change (increasing or decreasing) of the rotational velocity of the propeller shaft 9 at selected positions of the first and second segment 13", for manoeuvring the watercraft vehicle. The first arc segment is opposite the second arc segment on the other side of the axis of rotation RX.

This is achieved by the fact that the higher drive thrust, generated in the second arc segment 13" (see FIG. 7 and FIG. 6*f*), and the lower drive thrust, generated in the first arc segment 13', will pivot the propeller disc about the teetering hinge axis 26 involving that the direction of the total force of the main thrust of the propeller disc 11 is oriented in a direction different from the extension of the central axis CA of the watercraft vehicle 1.

Alternatively, the extension of the teetering hinge axis 26 is oriented perpendicular to the respective extension of the first and second arc segment 13', 13".

Alternatively, the first propeller blade pitch change involves increased angle of attack of the first propeller blade generating larger thrust of the first propeller blade in the first arc segment and a second propeller blade pitch change involves decreased angle of attack of the second propeller blade generating smaller thrust of the second propeller blade in the second arc segment.

FIG. 7 illustrates a propeller disc 11 of a watercraft vehicle 1 according to a tenth example. A control circuitry (not shown) is configured to provide a first drive thrust in a first arc segment 13' of a propeller disc 11 and to provide a second drive thrust in a second arc segment 13" of the propeller disc 11 by controlling a rate of change of rotational velocity v of a propeller shaft 9 coupled to a propeller assembly 7 forming the propeller disc 11 under rotation about an axis of rotation RX.

The propeller assembly 7 comprises a first propeller blade 8 and an opposite second propeller blade 10. The first propeller blade 8 performs a first propeller blade pitch change about a first oblique axis (not shown, see e.g. FIG. 6*a*) and the second propeller blade 8 performs a second propeller blade pitch change about a second oblique axis (not shown, see e.g. FIG. 6*a*), by momentary accelerating or decelerating the rotational velocity of the propeller assembly 7 when the first propeller blade 8 reaches the first arc segment 13' at the same time as the second propeller blade 10 reaches the second arc segment 13". A sensor arrangement of a control circuitry is configured to detect the angular position of the first and second propeller blades 8, 10. The control circuitry is configured to, from received control signals, define new positions of the first and second arc segment 13', 13" upon desired manoeuvres to be made.

FIG. 8 illustrates a further example of a watercraft vehicle 1 having a hull 28, which watercraft vehicle 1 also makes use of a second propeller 7'. Propeller blades of a first propeller 7 and the second propeller 7' are folded toward and against the hull 28 for compact storage of the watercraft vehicle 1 in a launching chamber 88.

FIG. 9 illustrates a watercraft vehicle 1 according to a further example. The watercraft vehicle 1 comprises a camera 91 configured for generating remote sensing images and comprises a global positioning system GPS receiver 93. A control circuitry 5 of the watercraft vehicle 1 is coupled to the camera 91 and to the global positioning system GPS receiver 93.

Alternatively, the watercraft vehicle 1 may comprise a thermal detector, an ultra-sonic detector, and/or an underwater object sensing detector.

A motor 3 is coupled to a propeller shaft 9 via a gear mechanism 95. The propeller shaft 9 is coupled to a propeller 7 having a first propeller blade 8 and a second propeller blade 10, each propeller blade is hingedly coupled to the propeller shaft 9 via a respective oblique axis.

The control circuitry 5 is configured to, twice per revolution of the propeller shaft 9, momentary change the drive thrust of the motor 3 for providing acceleration of the first propeller blade 8 and the second propeller blade 10, wherein the first propeller blade 8 pivots to a lower angle of attack and the second propeller blade 10 pivots to a higher angle of attack, thereby turning the watercraft vehicle. A first propeller blade pitch change involves decreased angle of attack of the first propeller blade 8 generating lower thrust of the first propeller blade 8 than the thrust generated by the second propeller blade 10. A second propeller blade pitch change involves increased angle of attack of the second propeller blade 10 generating higher thrust of the second propeller blade 10 than the thrust generated by the first propeller blade 8. A communication circuitry 94 is configured to communicate with the other co-operative watercraft vehicles.

FIG. 10 illustrates a set of co-operative watercraft vehicles 1 according to a further example. The watercraft vehicles 1 are configured as air-dropped AUV drones launched from an aircraft 99 in the water w. The watercraft vehicles 1 propel themselves in an intelligent and co-operative manner. In such way is provided a low-cost, intelligent and compact set of co-operative watercraft vehicles configured for e.g. search-and-rescue mission. Each watercraft vehicle comprises a communication circuitry (see FIG. 9 and ref. 94) coupled to the control circuitry 5, the communication circuitry 94 is configured to communicate with the other co-operative watercraft vehicles.

Figure 11:
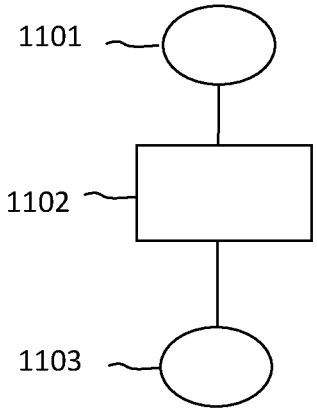
FIG. 11 illustrates a flowchart showing an exemplary method of manoeuvring a watercraft vehicle according to a further example.

FIG. 11 illustrates a flowchart showing an exemplary method of manoeuvring a watercraft vehicle according to a further example. The watercraft vehicle comprises a drive motor arrangement coupled to a control circuitry configured for manoeuvring the watercraft vehicle; a propeller shaft coupled between the drive motor arrangement and a propeller assembly, forming a propeller disc during rotation of said propeller shaft about an axis of rotation; a hub member of the propeller shaft coupled to the propeller assembly; a first propeller blade of the propeller assembly being hingedly coupled to a first oblique lag-pitch hinge of the hub member; a second propeller blade of the propeller assembly being hingedly coupled to a second oblique lag-pitch hinge of the hub member; a first oblique axis of the first oblique lag-pitch hinge being oriented in a direction oblique to the axis of rotation; a second oblique axis of the second oblique lag-pitch hinge being oriented in a direction oblique to the axis of rotation and parallel with the first oblique axis; the control circuitry being configured to provide a first drive thrust in a first arc segment of the propeller disc and to provide a second drive thrust in a second arc segment of the propeller disc by controlling a rate of change of rotational velocity.

The method comprises a first step 1101 starting the method. A second step 1102 shows the performance of the method. A third step 1103 comprises stopping of the method.

The second step 1102 may comprise; rotating the propeller shaft about the axis of rotation forming the propeller disc; changing the rotational velocity for achieving said rate of change of rotational velocity in said first arc segment for providing a first propeller blade pitch change about the first oblique axis and for achieving said rate of change of rotational velocity in said second arc segment for providing a second propeller blade pitch change about the second oblique axis; increasing the angle of attack of the first propeller blade by said first propeller blade pitch change generating larger thrust of the first propeller blade in the first arc segment; decreasing the angle of attack of the second propeller blade by said second propeller blade pitch change generating smaller thrust of the second propeller blade in the second arc segment, and providing constant rate of rotation of the propeller shaft for generating linear thrust.

Figure 12:
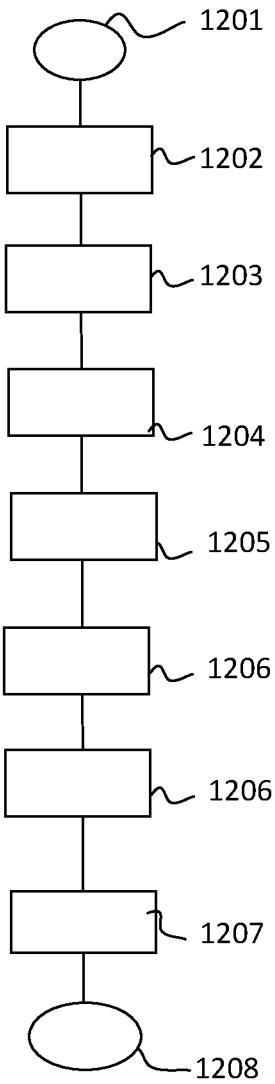
FIG. 12 illustrates a flowchart showing an exemplary method of manoeuvring a watercraft vehicle according to a further example.

FIG. 12 illustrates a flowchart showing an exemplary method of manoeuvring a watercraft vehicle according to a further example. The method comprises a first step 1201 starting the method. A second step 1202 shows rotating the propeller shaft about the axis of rotation forming the propeller disc. A third step 1203 shows changing the rotational velocity for achieving said rate of change of rotational velocity in said first arc segment for providing a first propeller blade pitch change about the first oblique axis and for achieving said rate of change of rotational velocity in said second arc segment for providing a second propeller blade pitch change about the second oblique axis. A fourth step 1204 shows increasing the angle of attack of the first propeller blade by said first propeller blade pitch change generating larger thrust of the first propeller blade in the first arc segment. A fifth step 1205 shows decreasing the angle of attack of the second propeller blade by said second propeller blade pitch change generating smaller thrust of the second propeller blade in the second arc segment. A sixth step 1206 shows providing constant rate of rotation of the propeller shaft for generating linear thrust. A seventh step 1207 shows pivoting the propeller disc about a teetering hinge axis by the provided first and second propeller blade pitch change. A seventh step 1208 comprises stopping of the method.

Alternatively, the method steps 1204 and 1205 comprises the further step of in that the control circuitry being configured to increase, when the first propeller blade is positioned in the first arc segment and/or the second propeller blade is positioned in the second arc segment, momentary the rotation rate of the propeller shaft (changing the drive thrust) so that a first propeller blade pitch change involves increased angle of attack and/or the second propeller blade pitch change involves decreased angle of attack.

Figure 13:
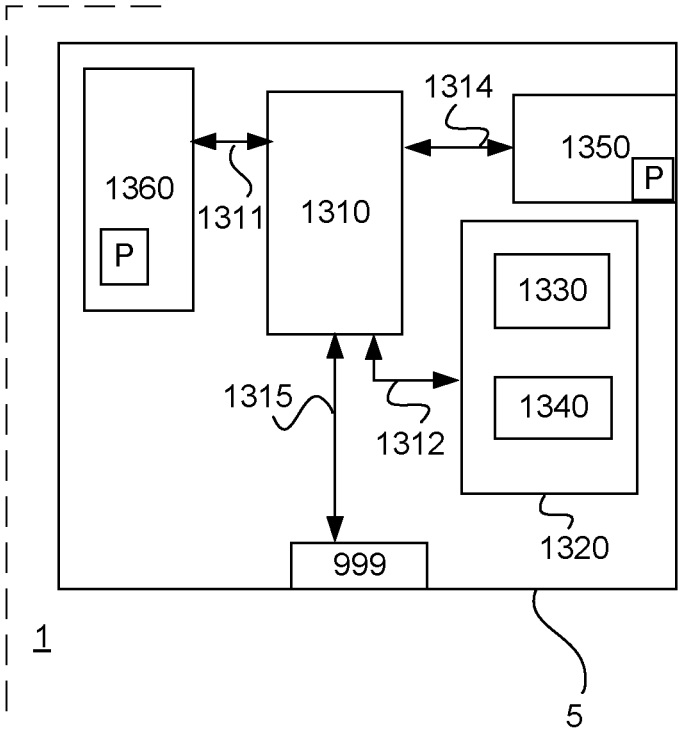
FIG. 13 illustrates a control circuitry of a watercraft vehicle according to a further example.

FIG. 13 illustrates a control circuitry 5 of a watercraft vehicle 1 according to a further example. The control circuitry 5 is coupled to a drive motor arrangement.

The control circuitry of the watercraft vehicle 1 is configured to pivot the hub and thus the propeller disc about the teetering hinge axis by controlling rate of change of the rotational velocity of the propeller shaft momentary when the first and second propeller blade reaching the respective first and second arc segment of the propeller disc.

The control circuitry may be configured for manoeuvring the autonomous underwater vehicle 1 by providing a first drive thrust in the first arc segment and to provide a second drive thrust in a second arc segment for pivoting the propeller disc for manoeuvring the watercraft vehicle 1. The control circuitry 5 is configured to manoeuvre the watercraft vehicle 1 by selecting and defining first and second arc segments from desired manoeuvring. The watercraft vehicle 1 comprises the drive motor arrangement (not shown) coupled to the control circuitry. A propeller shaft (not shown) is coupled between the drive motor arrangement and a propeller assembly forming a propeller disc during rotation of said propeller shaft about an axis of rotation. The control circuitry 5 is configured to manage the rate of change of the rotational velocity of the propeller shaft momentary in selected first and second arc segment of the propeller disc. A hub member of the propeller shaft coupled to the propeller assembly. A first propeller blade of the propeller assembly being hingedly coupled to a first oblique lag-pitch hinge of the hub member and a second propeller blade of the propeller assembly being hingedly coupled to a second oblique lag-pitch hinge of the hub member. A first oblique axis of the first oblique lag-pitch hinge being oriented in a direction oblique to the axis of rotation and a second oblique axis of the second oblique lag-pitch hinge being oriented in a direction oblique to the axis of rotation (RX) and parallel with the first oblique axis. The control circuitry 5 being configured to provide a first drive thrust in a first arc segment of the propeller disc and to provide a second drive thrust in a second arc segment of the propeller disc by controlling a rate of change of the rotational velocity, wherein first propeller blade pitch change is achieved about the first oblique axis and second propeller blade pitch change is achieved about the second oblique axis.

The control circuitry 5 comprises a computer. The control circuitry 5 comprises a non-volatile memory NVM 1320, which is a computer memory that can retain stored information even when the computer is not powered.

The control circuitry 5 further comprises a processing unit 1310 and a read/write memory 1350. The NVM 1320 comprises a first memory unit 1330. A computer program (which can be of any type suitable for any operational data) is stored in the first memory unit 1330 for controlling the functionality of the control circuitry 5. Furthermore, the control circuitry 5 comprises a bus controller (not shown), a serial communication left (not shown) providing a physical interface, through which information transfers separately in two directions.

The control circuitry 5 may comprise any suitable type of I/O module (not shown) providing input/output signal transfer, an A/D converter (not shown) for converting continuously varying signals from a sensor arrangement (not shown) of the control circuitry configured to detect the angular position of the first and second propeller blades, wherein the control circuitry is configured to, from received control signals, define new positions of the first and second arc segment upon desired watercraft vehicle manoeuvres to be made, and information about the rate of change of the rotational velocity and/or rate of rotational velocity, into binary code suitable for the computer, and from other operational data.

The control circuitry 5 also comprises an input/output unit (not shown) for adaptation to time and date. The control circuitry 5 comprises an event counter (not shown) for counting the number of event multiples that occur from independent events in operation of the watercraft vehicle 1.

Furthermore, the control circuitry 5 includes interrupt units (not shown) associated with the computer for providing a multi-tasking performance and real time computing for automatically and/or autonomous maneuvering the watercraft vehicle 1. The NVM 1320 also includes a second memory unit 1340 for external sensor check of the sensor arrangement.

A data medium for storing a program P may comprise program routines for automatically adapting the maneuvering of the watercraft vehicle 1 in accordance with operational data of co-operative watercraft vehicles manoeuvring and/or autonomous manoeuvring by means of the control circuitry 5.

The data medium for storing the program P comprises a program code stored on a medium, which is readable on the computer, for causing the control circuitry 5 to perform the method and/or method steps described herein.

The program P further may be stored in a separate memory 1360 and/or in the read/write memory 1350. The program P, in this embodiment, is stored in executable or compressed data format.

It is to be understood that when the processing unit 1310 is described to execute a specific function that involves that the processing unit 1310 may execute a certain part of the program stored in the separate memory 1360 or a certain part of the program stored in the read/write memory 1350.

The processing unit 1310 is associated with a data port 999 for communication via a first data bus 1315 able to be coupled to the drive motor arrangement for momentary change the drive thrust of the motor for providing acceleration or deceleration of the first propeller blade and the second propeller blade in a respective first and second arc segment, wherein the first propeller blade pivots to a lower angle of attack and the second propeller blade pivots to a higher angle of attack (achieved by parallel first and second oblique lag-pitch hinge axes of the hub), thereby turning the watercraft vehicle.

The non-volatile memory NVM 1320 is adapted for communication with the processing unit 1310 via a second data bus 1312. The separate memory 1360 is adapted for communication with the processing unit 610 via a third data bus 1311. The read/write memory 1350 is adapted to communicate with the processing unit 1310 via a fourth data bus 1314.

The data port 999 is preferably connectable to data links connected to e.g. an under-water object sensing detector, a global positioning system GPS receiver and/or other sensor devices. When data is received by the data port 999, the data will be stored temporary in the second memory unit 1340.

After that the received data is temporary stored, the processing unit 1310 will be ready to execute the program code, according to the above-mentioned method.

Preferably, the signals (received by the data port 999) comprise information about operational status of the drive motor arrangement. The signals may also comprise information regarding rate of change of the rotational velocity of the propeller shaft, the rotational velocity of the drive motor arrangement, positions of co-operative watercraft vehicles, or other information.

The received signals at the data port 999 can be used by the control circuitry 5 for controlling and monitoring automatic calibration of the sensor device 1.

Information and data may be manually fed to the control circuitry via a suitable communication device, such as a computer display or a touchscreen.

The method can also partially be executed by the control circuitry 5 by means of the processing unit 1310, which processing unit 1310 runs the program P being stored in the separate memory 1360 or the read/write memory 1350. When the control circuitry 5 runs the program P, the suitable method steps disclosed herein will be executed.

The present invention is of course not in any way restricted to the preferred embodiments described above, but many possibilities to modifications, or combinations of the described embodiments thereof should be apparent to a person with ordinary skill in the art without departing from the basic idea of the invention as defined in the appended claims.

The invention claimed is:

1. A watercraft vehicle (1) comprising:

a drive motor arrangement (3) coupled to a control circuitry (5) configured for manoeuvring the watercraft vehicle (1);

a propeller shaft (9) coupled between the drive motor arrangement (3) and a propeller assembly (7) forming a propeller disc (11) during rotation of said propeller shaft (9) about an axis of rotation (RX); and a hub member (17) of the propeller shaft (9) coupled to the propeller assembly (7), wherein:

a first propeller blade (8) of the propeller assembly (7) is hingedly coupled to a first oblique lag-pitch hinge (22') of the hub member (17);

a second propeller blade (10) of the propeller assembly (7) is hingedly coupled to a second oblique lag-pitch hinge (22") of the hub member (17);

a first oblique axis (21') of the first oblique lag-pitch hinge (22') is oriented in a direction oblique to the axis of rotation (RX);

a second oblique axis (21") of the second oblique lag-pitch hinge (22") is oriented in a direction oblique to the axis of rotation (RX) and parallel with the first oblique axis (21");

the control circuitry (5) is configured to provide a first drive thrust (T') in a first arc segment (13') of the propeller disc (11) and to provide a second drive thrust (T") in a second arc segment (13") of the propeller disc (11) by controlling a rate of change of the rotational velocity of the propeller shaft (9);

a first propeller blade pitch change is achieved about the first oblique axis (21'); and a second propeller blade pitch change is achieved about the second oblique axis (21").

2. The watercraft vehicle (1) according to claim 1, wherein the first drive thrust (T') is higher than the second drive thrust (T").

3. The watercraft vehicle (1) according to claim 2, wherein the first arc segment (13') is opposite the second arc segment (13").

4. The watercraft vehicle (1) according to claim 1, wherein the first arc segment (13') is opposite the second arc segment (13").

5. The watercraft vehicle (1) according to claim 1, wherein the hub member (17) is hingedly coupled to the propeller shaft (9) via a teetering hinge (25) having a teetering hinge axis (26), which is oriented normal to the axis of rotation (RX) of the propeller shaft (9).

6. The watercraft vehicle (1) according to claim 5, wherein the control circuitry (5) is configured to pivot the propeller disc (11) about the teetering hinge axis (26) by controlling said rate of change of the rotational velocity.

7. The watercraft vehicle (1) according to claim 1, wherein a first propeller blade pitch change involves increased angle of attack of the first propeller blade (8) generating larger thrust of the first propeller blade (8) in the first arc segment (13') and a second propeller blade pitch change involves decreased angle of attack of the second propeller blade (10) generating smaller thrust of the second propeller blade (10) in the second arc segment (13").

8. The watercraft vehicle (1) according to claim 1, wherein the control circuitry (5) is configured to momentary increase, when the first propeller blade (8) is positioned in the first arc segment (13') and the second propeller blade (10) is positioned in the second arc segment (13"), the rotational velocity of the propeller shaft (9) so that the first propeller blade pitch change involves increased angle of attack and the second propeller blade (10) pitch change involves decreased angle of attack.

9. The watercraft vehicle (1) according to claim 1, wherein:

a first angle of 45° is defined between the first oblique axis (21') and the axis of rotation (RX); and a second angle of 45° is defined between the second oblique axis (21") and the axis of rotation (RX).

10. A method of manoeuvring a watercraft vehicle (1), the method comprising the steps of:

providing a watercraft vehicle comprising:

a drive motor arrangement (3) coupled to a control circuitry (5) configured for manoeuvring the watercraft vehicle (1);

a propeller shaft (9) coupled between the drive motor arrangement (3) and a propeller assembly (7), forming a propeller disc (11) during rotation of said propeller shaft (9) about an axis of rotation (RX);

a hub member (17) of the propeller shaft (9) coupled to the propeller assembly (7);

a first propeller blade (8) of the propeller assembly (7) hingedly coupled to a first oblique lag-pitch hinge (22') of the hub member (17);

a second propeller blade (10) of the propeller assembly (7) hingedly coupled to a second oblique lag-pitch hinge (22") of the hub member;

a first oblique axis (21') of the first oblique lag-pitch hinge (22") oriented in a direction oblique to the axis of rotation (RX);

a second oblique axis (21") of the second oblique lag-pitch hinge (22") oriented in a direction oblique to the axis of rotation (RX) and parallel with the first oblique axis (21');

wherein the control circuitry (5) is configured to provide a first drive thrust (T') in a first arc segment (13') of the propeller disc (11) and to provide a second drive thrust (T") in a second arc segment (13") of the propeller disc (11) by controlling a rate of change of the rotational velocity of the propeller shaft (9), wherein a first propeller blade pitch change is achieved about the first oblique axis (21') and a second propeller blade pitch change is achieved about the second oblique axis (21");

rotating the propeller shaft (9) about the axis of rotation (RX) forming the propeller disc (11);

changing the rotational velocity for achieving said rate of change of rotational velocity in said first arc segment (13') for providing a first propeller blade pitch change about the first oblique axis (21') and for achieving said rate of change of rotational velocity in said second arc segment (13") for providing a second propeller blade pitch change about the second oblique axis (21");

increasing the angle of attack of the first propeller blade (8) by said first propeller blade pitch change generating larger thrust (T') of the first propeller blade (8) in the first arc segment (13');

decreasing the angle of attack of the second propeller blade (10) by said second propeller blade pitch change generating smaller thrust (T") of the second propeller blade (10) in the second arc segment (13"), and providing constant rate of rotation of the propeller shaft (9) for generating linear thrust.

11. The method according to claim 10, further comprising the step of pivoting the propeller disc (11) about a teetering hinge axis (26) by the provided first and second propeller blade pitch change.

12. A set of co-operative watercraft vehicles (1) of the type according to claim 1, each watercraft vehicle (1) comprising a communication circuitry (94) coupled to the control circuitry (5), the communication circuitry (94) being configured to communicate with the other co-operative watercraft vehicles.

13. A data medium storing a data program (P) configured for manoeuvring a watercraft vehicle (1) according to claim 1, wherein said data program (P) comprises a non-transitory program code stored on the data medium, which is readable on a computer, for causing the control circuitry (5) to perform the steps of:

rotating the propeller shaft (9) about the axis of rotation (RX) forming the propeller disc (11);

changing the rotational velocity for achieving said rate of change of rotational velocity in said first arc segment (13') for providing a first propeller blade pitch change about the first oblique axis (21') and for achieving said rate of change of rotational velocity in said second arc segment (13") for providing a second propeller blade pitch change about the second oblique axis (21");

increasing the angle of attack of the first propeller blade (8) by said first propeller blade pitch change generating larger thrust of the first propeller blade (8) in the first arc segment (13');

decreasing the angle of attack of the second propeller blade (10) by said second propeller blade pitch change generating smaller thrust of the second propeller blade (10) in the second arc segment (13"), and providing constant rate of rotation of the propeller shaft (9) for generating linear thrust.

14. A computer program product comprising a program code stored on the data medium according to claim 13.

15. A data medium storing a data program (P) that comprises a non-transitory program code stored on the data medium, which is readable on a computer, for causing control circuitry (5) to perform the method of claim 10.

* * * * *